US006109959A

United States Patent [19]

Burlinson et al.

[11] Patent Number: 6,109,959

[45] Date of Patent: Aug. 29, 2000

[54] ELECTRICAL SOCKET DEVICE

[75] Inventors: Malcolm John Burlinson, Bury St. Edmunds; David Maurice Burlinson, Mildenhall; Ian Clarke, Okehampton, all of United Kingdom

[73] Assignee: Sapphire Networks, Limited, Fordham Ely Cambs

[21] Appl. No.: 09/077,164

[22] PCT Filed: Nov. 22, 1996

[86] PCT No.: PCT/GB96/02891

§ 371 Date: May 21, 1998

§ 102(e) Date: May 21, 1998

[87] PCT Pub. No.: WO97/20367

PCT Pub. Date: Jun. 5, 1997

[30] Foreign Application Priority Data

Nov. 24, 1995 [GB] United Kingdom ..... 9524114

[51] Int. Cl.[7] ..... H01R 13/60

[52] U.S. Cl. ..... 439/536; 439/676

[58] Field of Search ..... 439/535, 536, 439/76.1, 676, 98

[56] References Cited

U.S. PATENT DOCUMENTS

| | | | |
|---|---|---|---|
| 4,756,695 | 7/1988 | Lane | 439/535 |
| 4,986,779 | 1/1991 | Ferrill et al. | 439/535 |
| 5,228,869 | 7/1993 | Below | 439/536 |
| 5,518,423 | 5/1996 | Green et al. | 439/557 |
| 5,695,361 | 12/1997 | Elisei | 439/535 |

FOREIGN PATENT DOCUMENTS

| | | |
|---|---|---|
| 2 282 273 | 9/1993 | United Kingdom . |
| WO 95/31840 | 5/1995 | WIPO . |

*Primary Examiner*—Neil Abrams
*Attorney, Agent, or Firm*—Wall Marjama Bilinski & Burr

[57] ABSTRACT

A computer network wall outlet device adapted to be mounted in an apertured wall plate includes a face plate member and a body member which are releasably interconnected to one another. The face plate member, releasably mounted to an aperture in the wall plate, includes a socket aperture aligned with a socket of the body member, the socket having an array of electrical contacts. The body member also retains a printed circuit board having a plurality of electric connections for conductors of a network cable. The device permits maintenance of the printed circuit board without requiring disconnection of the outlet device from the network due to the releasable interconnection of the face plate member. Preferably, the socket and the electrical connections are on the same side of the printed circuit board. Moreover, the device further includes IDC connectors and a ground strap carried by the circuit board for connection to a shield of the cable. The device members may be formed from a metal plated plastic.

13 Claims, 3 Drawing Sheets

ELECTRICAL SOCKET DEVICE

FIELD OF THE INVENTION

The invention relates to electrical connectors of the nature of plug and socket devices, and more particularly, but not exclusively, to electrical socket devices intended to connect computers and associated apparatus to computer networks, such electrical socket devices being known as outlet ports, or wall outlet devices.

BACKGROUND ART

It is known to provide modular network wall outlets but the known devices are not without difficulties and complications as regards their manufacture and/or installation.

Conventionally the components making up the outlet devices are mounted on a face plate component adapted to be mounted on to the front of a wall plate. The face plate conventionally carries a member defining a jack plug socket, a member carrying an array of cable terminals, i.e. IDC terminals, and a printed circuit board connecting an array of contacts in the socket with the IDC terminals. In such an arrangement, the socket forming member will normally have to face in a direction opposite to that of the IDC terminals. Thus the socket will be arranged to open through the face plate while the IDC terminals will be arranged to project from the rear of the face plate so that they are accessible for connection to a network cable by an installation engineer.

It is an object of the invention to provide a network outlet device which is relatively easy to manufacture or assemble in that the main electrical components, i.e. the terminals (e.g. IDC terminals) and the socket member can be assembled on a single printed circuit board, and preferably all on the same side of the board.

It is a particular object of the invention to provide an outlet device in which the terminals are separable from the part of the device by which it is fixed in position during use, e.g. the face plate, to facilitate installation.

It is another object of the invention to provide a network outlet port which facilitates installation.

It is a further object of the invention to provide an electrically shielded network outlet port.

It is a yet further object of the invention to provide a network wall outlet made from relatively simple components.

It is a still further object of the invention to provide a wall outlet which lends itself to a situation where limited space, and particularly limited depth, is available.

The outlet in accordance with the invention facilitates installation in that the assembly comprising the cover carrying the printed circuit board which in turn carries the jack socket and the electrical connectors can be wired to an electrical cable before the cover is mounted on the back box or back box-and-face plate assembly. Thus, the installation engineer can wire the outlet without having first to pass the tail of the cable through a wall plate aperture, as is normally the case.

The invention thus provides an improved electrical outlet.

The present invention is an electrical outlet device comprising a member defining a socket aperture, means defining a socket aligned with the socket aperture and having an array of electrical contacts therein and means by which the outlet device is secured in position in use, characterised by a body member having a plurality of electrical connections for conductors in a cable, and by means forming electrical connections between the cable connections and the array of electrical contacts in the socket, and in that the body member is releasably connected to the socket aperture defining member.

The socket aperture defining member may carry the means by which the outlet device is secured in position in use. The means defining the socket may be mounted on the body member. The body member may be a push fit on the socket defining member. Snap-action connections may be provided to releasably connect the body member and the socket aperture defining member. The snap-action connectors may be arranged for engaging opposed ends of the respective said members.

The socket aperture defining member may be a face plate adapted for reception in or on a wall plate to secure the outlet device in position in use. The face plate may comprise a front face member, a pair of flanges extending rearwardly from positions adjacent to opposed ends of the rear of the front face member, means limiting the depth of insertion of the face plate into an aperture in the wall plate and the pair of flanges being adapted for releasably receiving the body member.

The body member may be a cover formed as an open-topped box-like structure. The cover may be secured to the said socket aperture defining member by means of a back box adapted to mate snugly with the cover to form a closed box-like structure enclosing electrical components of the outlet device. The back box may be an open-topped box-like structure. The closed box-like structure may comprise metal plated plastics mouldings forming an electrical shield enclosing the outlet device.

The outlet device may comprise a shutter for closing the aperture in the member, the shutter being slidably mounted between the member and back box, and being resiliently urged to close the aperture.

The electrical outlet device may comprise a printed circuit board carried by the cover and which forms the conductor means for connecting the cable connections to the contact array in the socket defining member. The socket defining member may be mounted on the printed circuit board. The printed circuit board may carry a cable retaining strap adapted to be secured to the cable. The cable retaining strap may be electrically connected to an earthed portion of the printed circuit board. The cable retaining strap may be electrically connected to the shielding provided by the metal plating on the closed box-like structure. The cable restraining strap may be adapted for connection to the shielding around the electric cable.

The outlet device may comprise snap-action connections securing the cover and the back box together.

It will be understood that the socket device of the present invention enables an installation engineer to fit a computer network cable to the cover while it is separated from the face plate, thus facilitating the installation process, whereas with a conventional socket device, the tail of the network cable must be passed through the aperture in the wall plate which is to receive the face plate, before the cable can be connected to the socket device. Thus with the device of the present invention, the cable tails can be shorter.

BRIEF DESCRIPTION OF DRAWINGS

The invention is diagrammatically illustrated, by way of example, in the accompanying drawings in which.

DETAILED DESCRIPTION OF THE INVENTION

Figure 2:
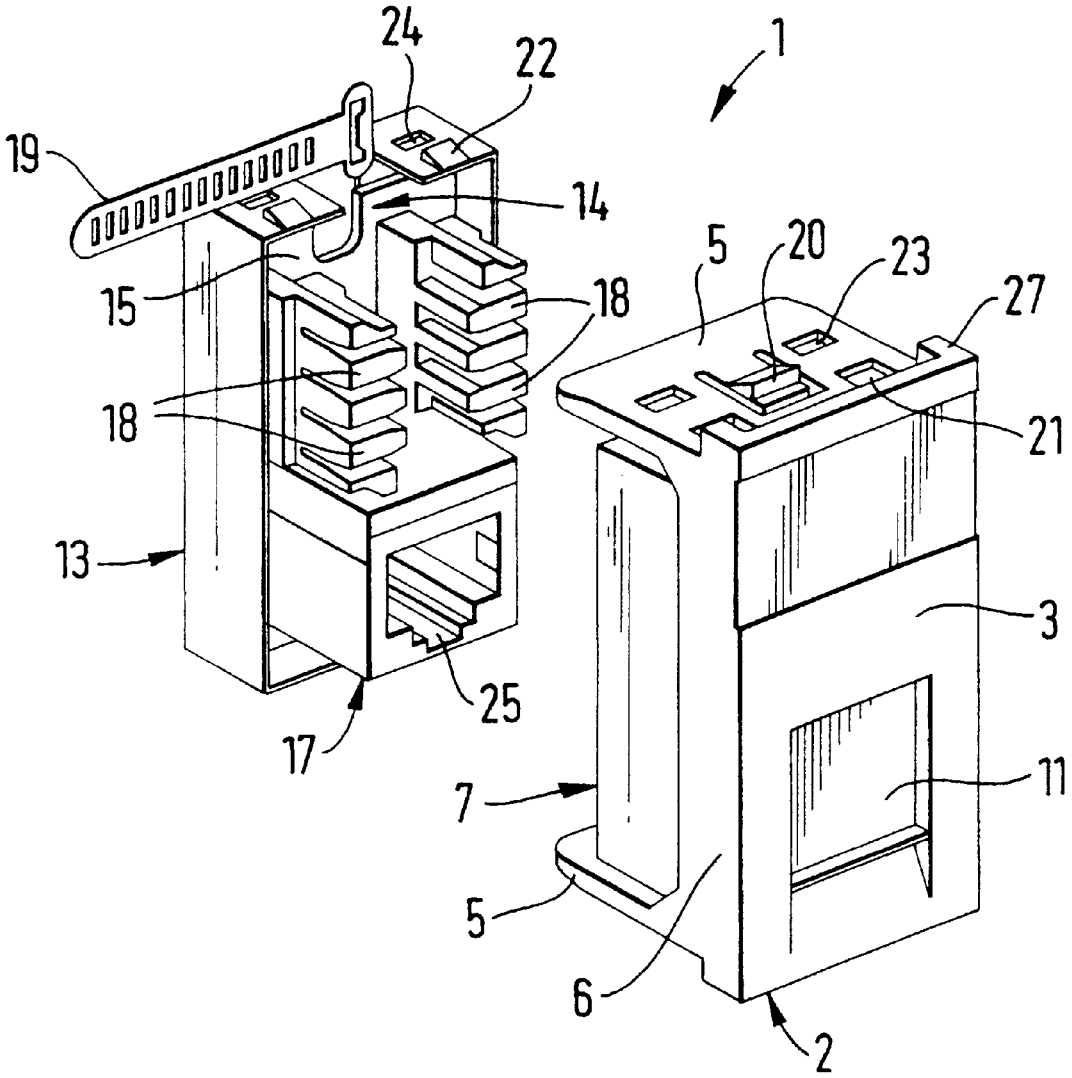
FIG. 2 is an exploded perspective view of the outlet of FIG. 1 with the various components of the outlet partly assembled to form two sub-assemblies.

In the drawings there is shown an electrical socket device (1) intended as a modular computer network outlet and comprising a generally rectangular face plate (2) having a front face member (3) formed with a generally square aperture (4) through which a plug or jack (not shown) can be inserted to make electrical contact with the outlet. The face plate (2) comprises a pair of flanges (5) extending rearwardly from its front face member (3) adjacent to opposite ends (27) thereof and which are formed with snap-action catches (20) (see FIG. 2) by which the face plate may be engaged in an aperture in a wall plate (not shown). Such a manner of engagement is known as such and involves inserting the face plate into the wall plate from the front of the wall plate until the ends (27) engage the wall plate whereupon the catches (20) engage the rear of the wall plate to fix the face plate in position. Relatively narrow webs (6) (only one of which is visible in the drawings) extend between the flanges (5) along opposite sides of the face plate to form a shallow tray on the rear surface of the face plate for receiving and locating a back box (7).

The back box (7) is an open-topped box-like structure having a locating lug (8) projecting from one end for the purpose appearing below and which is formed with an aperture (9) in its bottom face which aligns with the corresponding aperture (4) in the face plate (2). The back box (7) is adapted to be received snugly in the tray in the rear face of the face plate (2) and to engage with the face plate by means of snap action connections (21) (see FIG. 2) whereby the face plate and the back box form a unitary assembly which trap between them a sliding shutter (11) which is urged to close the aperture (4) in the face plate by means of a spring (12) located between the face plate and the back box.

Figure 1:
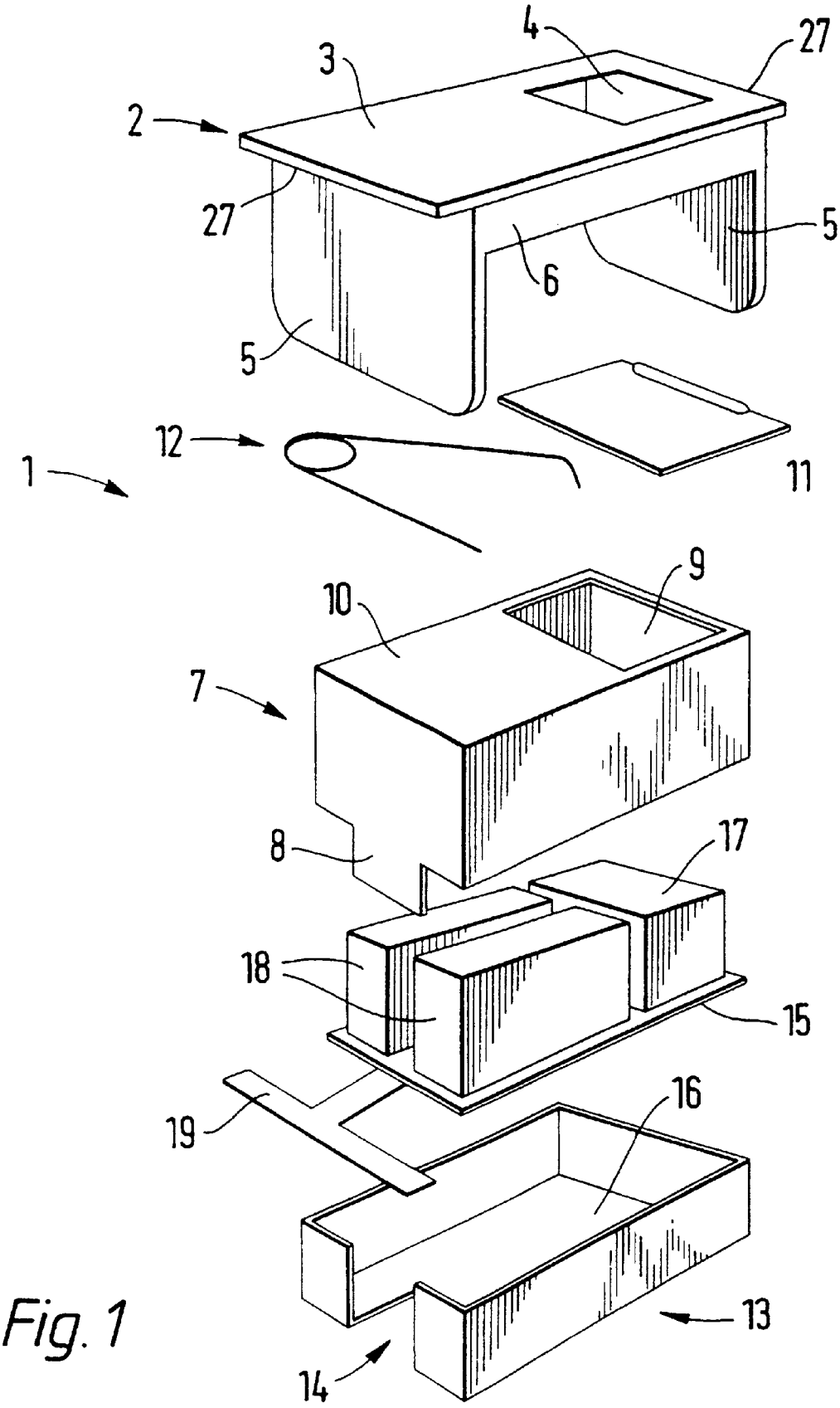
FIG. 1 is an exploded perspective view of a modular computer network outlet.

The open side of the back box (which faces downward in FIG. 1 and rearwardly in FIG. 2) is closed by means of a cover (13) which is an open-topped box-like structure adapted to mate snugly with the back box (7) and to be held on the back box by means of snap-action connectors (22) or the like on the cover and which engage in corresponding apertures (23) in the lugs (5). The cover (13) is formed with a cut-out or aperture (14) in one end through which an electrical network cable (not shown) may enter the box-like enclosure comprising the cover and the back box. The locating lug (8) is arranged to be received in the cut-out (14) to prevent mis-assembly. The back box (13) carries a printed circuit board (15) which is held in the base (16) of the back box by means of snap-action connectors (24) and the printed circuit board carries a member (17) defining a socket (25) for receiving the said plug or jack and a plurality of electrical connectors (18), for example IDC connectors, by which the individual conductors of the network cable are electrically connected to the device. Electrical connection between an array of contacts (not shown) in the jack socket (25) and the connectors (18) are provided by the printed circuit board (15) which also carries a metal strain relief and earthing strap-and-buckle device (19) which is intended to be wrapped around the network cable (not shown) and crimped thereto to provide a good mechanical connection of the cable to the electrical socket device and to earth the device to a printed circuit board and also to earth the device to a cable shield, if provided. Preferably the back box and the cover will be plated with metal which is electrically connected to the printed circuit board and thus to the network cable to shield the socket in use.

Figure 3:
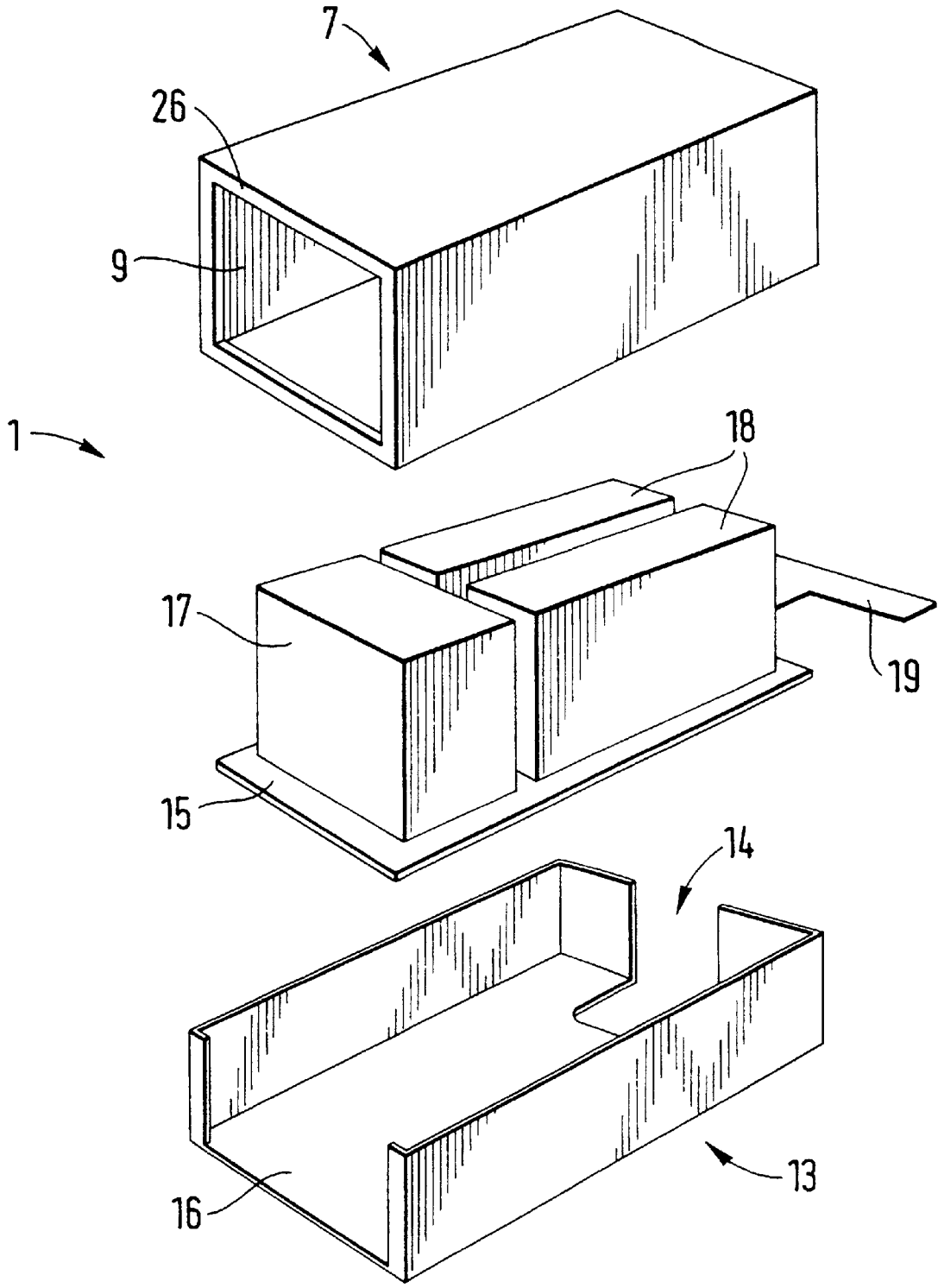
FIG. 3 is a view generally similar to that of FIG. 1 of a modified version of the outlet for use where a face plate is not required.

The outlet device of FIG. 3 is generally similar to that described above with reference to FIGS. 1 and 2 except that the face plate is not required and thus not present. Instead the outlet device is secured in position in use by connecting the back box directly to a suitable surface or aperture at the required site. The connection may be in any suitable manner e.g. by snap-action connectors (not shown) or the like.

As shown the jack plug outlet socket (25) emerges from the back box through an aperture (9) in an end face, although in this embodiment it could be arranged to emerge through any convenient face of the back box or cover.

It will be appreciated that normally the various components of the outlet will be plastics injection mouldings. The snap-action connections for holding the components of the outlet together may be replaced by other connections, e.g. welded connections or by means of an adhesive or any other suitable means.

What is claimed is:

1. A computer network wall outlet device adapted to be mounted in an apertured wall plate, said computer network wall outlet device comprising:

a face plate member having mounting means for mounting the face plate member in the aperture in the apertured wall plate and a socket aperture, said mounting means including snap-action means for releasably interconnecting a body member and the face plate member;

said body member including:

a cover formed as an open-topped box-like structure having snap-action connectors to connect the body member to the snap-action means of the face plate member;

a printed circuit board mounted in the cover;

a plurality of electrical connections for engaging conductors in a cable mounted on the circuit board;

a socket mounted on the circuit board, said socket being aligned with the socket aperture on the face plate member, and having an array of electrical contacts therein;

wherein said circuit board forms electrical connections between the cable connections and the array of electrical contacts in the socket and wherein the electrical connections and the socket are each mounted on the same side of the circuit board.

2. A computer network wall outlet device according to claim 1, wherein the body member is push fitted on the face plate member.

3. A computer network wall outlet device according to claim 3, including oppositely disposed snap-action connectors for engaging opposed ends of the respective members.

4. A computer network wall outlet device according to claim 1, wherein the face plate member comprises a front face member, a pair of flanges extending rearwardly from positions adjacent to opposed ends of the rear of the front face member, and means limiting the depth of insertion of the face plate into the aperture in the wall plate and in that the pair of flanges are adapted for releasably receiving the body member.

5. A computer network wall outlet device according to claim 1, further comprising a back box adapted to mate snugly with the cover to form a closed box-like structure enclosing electrical components of the outlet device.

6. A computer network wall outlet device according to claim 7, wherein the back box is an open-topped box-like structure.

7. A computer network wall outlet device according to claim 5, wherein the closed box-like structure comprises metal plated plastics moldings forming an electrical shield enclosing the outlet device.

8. A computer network wall outlet device according to claim 7, wherein the printed circuit board carries a cable retaining strap which is adapted to be secured to the cable and which is electrically connected to the shielding provided by the metal plated plastic molding on the closed box-like structure.

9. A computer network wall outlet device according to claim 5, including a shutter for closing the aperture in the face plate member, the shutter being slidably mounted between the face plate member and back box, and being resiliently urged to close the aperture in the face plate member.

10. A computer network wall outlet device according to claim 5, including snap-action connections securing the cover and the back box together.

11. A computer network wall outlet device according to claim 1, wherein the printed circuit board carries a cable retaining strap adapted to be secured to the cable.

12. A computer network wall outlet device according to claim 11, wherein the cable retaining strap is electrically connected to an earthed portion of the printed circuit board.

13. A computer network wall outlet device according to claim 11, wherein the cable restraining strap is adapted for connection to the shielding around the electric cable.

* * * * *